United States Patent [19]

Arteaga et al.

[11] Patent Number: 4,801,083

[45] Date of Patent: Jan. 31, 1989

[54] COMPOUND RAILROAD TRACK

[76] Inventors: Alfredo G. Arteaga; Alfredo E. Arteaga, both of Serrano 2240, Floor 1, Dept. 9, Buenos Aires, Argentina, C.1425

[21] Appl. No.: 23,047

[22] Filed: Mar. 6, 1987

[51] Int. Cl.[4] ..... E01B 5/08

[52] U.S. Cl. ..... 238/134; 238/141; 238/144; 238/147; 238/311

[58] Field of Search ..... 238/134, 138, 139, 141, 238/129, 143, 144, 145, 146, 147, 311; 52/730, 732

[56] References Cited

U.S. PATENT DOCUMENTS 277,766 5/1883 McKenney ..... 238/143

FOREIGN PATENT DOCUMENTS 4797 11/1879 United Kingdom ..... 238/143

125748 3/1919 United Kingdom ..... 52/730

*Primary Examiner*—Robert B. Reeves

*Assistant Examiner*—Frank H. Williams, Jr.

*Attorney, Agent, or Firm*—Richard C. Litman

[57] ABSTRACT

A compound railroad track wherein the head rail is easily replaceable without replacement of the supports, which comprise two extruded mirror-image L-shaped members, periodically spaced U-shaped separators, and a base plate, all suitably bolted and welded together.

4 Claims, 1 Drawing Sheet

COMPOUND RAILROAD TRACK

BACKGROUND OF THE INVENTION

Ordinary railroad track consists of solid extruded steel with three main features. The top part or rail head is a thickened region that provides a suitable platform on which the flanged wheels of a train may fit. The web is the thin middle section of the rail that is strong enough to support the vertical weight of the train. The flanged bottom of the rail can be bolted to the base plate that rests on the ties, preventing vertical and side-to-side motions of the rail. The railroad track described in the present invention has similar outer cross-sectional appearance to that of ordinary track, but is composed of several parts in order to facilitate replacement of the wear component of a rail, namely, the rail head. All railroad track in use is subject to wear particularly at the joints between abutting rail sections. Problems also occur in the initial ease of manufacture and laying of track as well as in the replacement of worn track. In countries with mountainous terrain or inclement weather or in large countries with expansive rail systems, easier replacement of rail, heads provides a definite economic advantage in operation of the railroads.

DESCRIPTION OF THE PRIOR ART

The following patents contain material relating to the field of the present invention:

French No. 12,028, M. Bagot
U.S. Pat. No. 51,635, O. G. Warren
U.S. Pat. No. 73,282, P. Ashcroft
U.S. Pat. No. 84,401, H. Zahn
U.K. No. 1,079, Smith
U.K. No. 4,814, W. L. Thompson
U.S. Pat. No. 498,073, Morrison & Swin
U.S. Pat. No. 535,608, W. H. Wright
U.S. Pat. No. 1,085,015, L. Brewster
U.S. Pat. No. 1,178,031, W. H. Sellew
U.S. Pat. No. 1,260,148, W. G. Coughlin
U.S. Pat. No. 1,508,992, E. C. Shaver These patents all show construction of compound rails that comprise a thick head rail, are strengthened by horizontal side bolts, and have different amounts of void space within the rail cross section. The Ashcroft patent (U.S. Pat. No. 73,282), for example, shows a T-shaped rail head supported by two L-shaped girders clamped with horizontal side bolts. However, Ashcroft emphasizes a compound structure in which the vertical surfaces are wedged together with angular interlocking ribs and grooves, not separated as in the present invention. Another construction by Brewster (U.S. Pat. No. 1,085,015), shows a similar cross-sectional outline to the present invention, but the rail head is split vertically into two lateral sections that extend to the rail base. Sellew (U.S. Pat. No. 1,178,031), shows an I-shaped rail head supported by two vertical I-bar girders with side bolts. In Warren (U.S. Pat. No. 51,635), the rail head has two long depending flanges extending to the rail base at about the locations in the cross section where the rail head of the present invention is cut out for engagement of a pair of L-shaped support girders. Other prior constructions show nonvertical supports, which are not the most economical design to maximize vertical strength at a given weight. Although the object of the Coughlin patent is a compound rail in which the head or wearing portion of the rail is detachable from the continuous support (as in the present invention), the Coughlin construction is significantly different. Furthermore, none of the prior art constructions are strengthened with the U-shaped separators of the present invention, which combines simplicity of design with maximal strength and durability of components, while allowing ease in replacement of worn rail head. All of the cited prior art differ in significant aspects from the construction of the present invention.

SUMMARY OF THE INVENTION

Ordinary railroad track in use is constructed of single-piece extruded steel sections. Trains supported as they are by the top surfaces of the tracks produce abrasional wear and tear to said surfaces as a consequence of which the entire tracks have to be replaced periodically, particularly tracks that support high-speed or heavily loaded trains. The object of the present invention is to construct the rails in several pieces so that replacement of the rail head on which the trains ride can be performed without replacing the other components of the rail. Such operation is easier, quicker, and cheaper than the usual rail replacement procedure.

Another advantage of the new rail design is the increase in horizontal reaction strength due to the new web design which decreasing rail deformation during passage of trains. (The vertical forces are handled equally well by both ordinary and new rail designs.)

DESCRIPTION OF THE PREFERRED EMBODIMENT OF THE INVENTION

Figure 1:
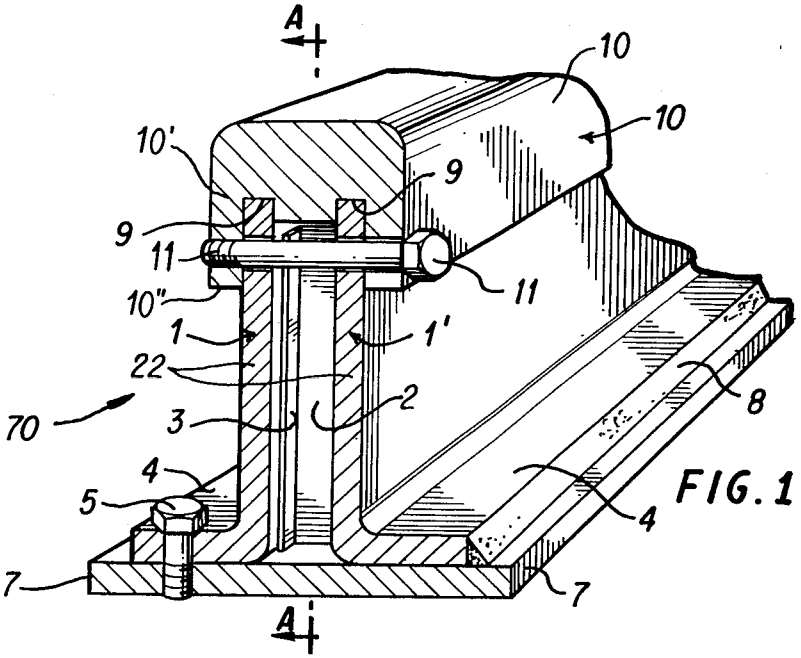
FIG. 1 is a cross-sectional view, in perspective, of the present invention illustrating a typical construction of the compound railroad track.
Figure 3:
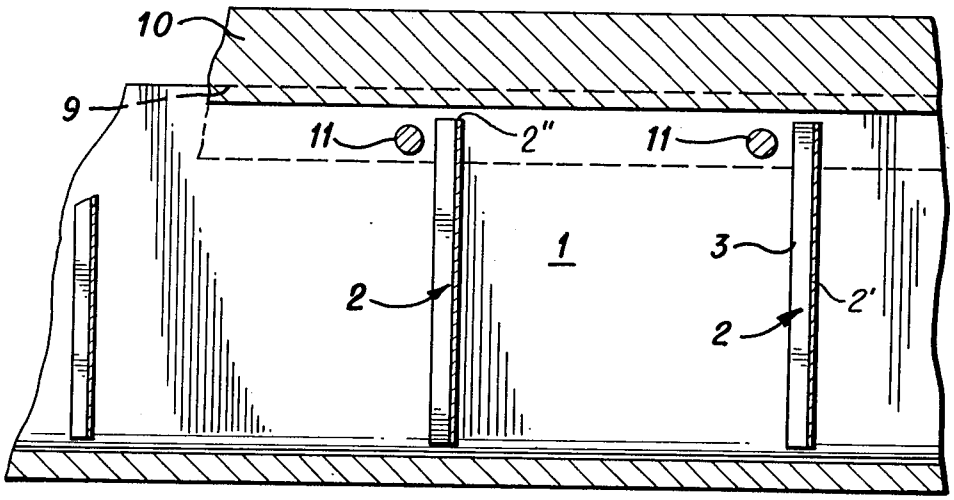
FIG. 3 is a vertical cross section along center plane A—A shown in FIG. 1.
Figure 2:
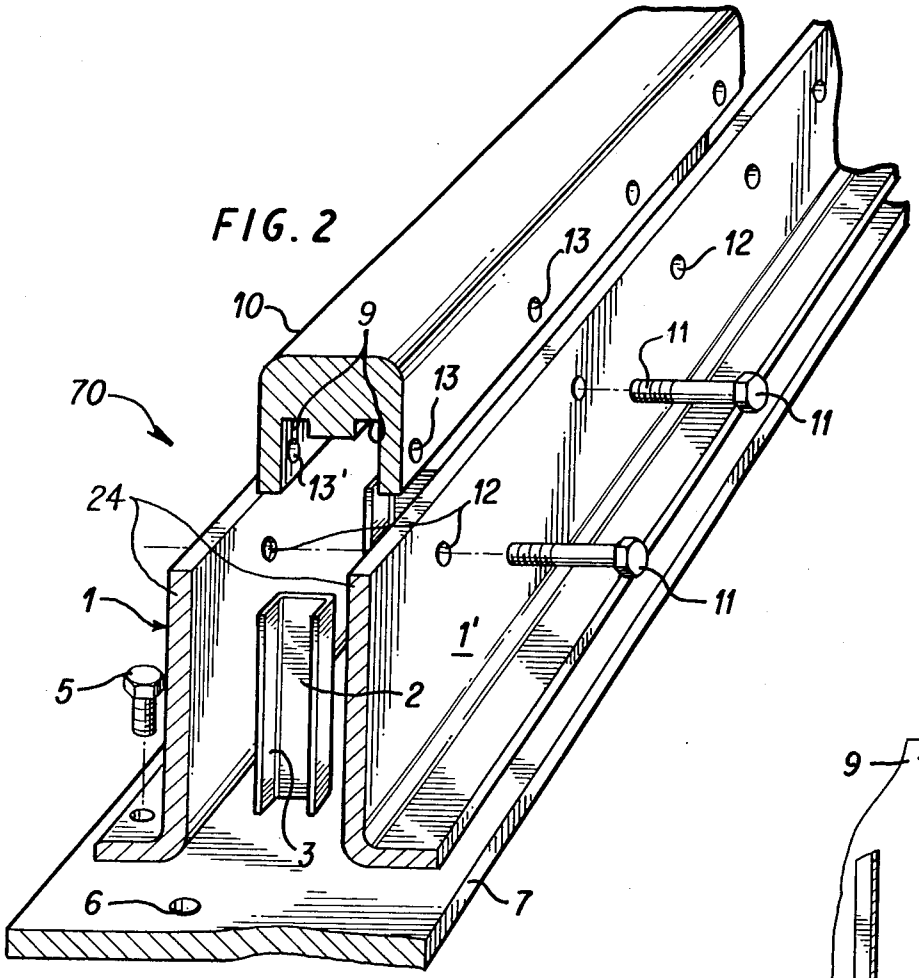
FIG. 2 is an exploded view of the same construction as in FIG. 1.

Referring to the drawings, there is shown in FIG. 1 a cross-sectional view of a compound railroad track 70 comprising a rail head 10 made of extruded steel, with a pair of laterally spaced apart, downwardly directed channels 9 suitable for direct support by two continuously extruded, vertical, mirror-image L-shaped longitudinal support members 1 and 1'. The rail head 10 includes a center segment 20 intermediate the two channels 9, 9 and outermost, depending flange portions 10',10' having lower edges 10'',10'' disposed well below the center segment 20. Included are and periodically spaced, vertical U-shaped separators 2 having top edges 2'' and each having a transverse base 2' joined to a pair of side walls 3,3 the distance between the outer surfaces of which corresponds to the space between the two channels 9,9. Each support member 1,1' comprises a vertically disposed web 22 joined to a horizontally extending base or foot 4. The support members 1,1' are initially assembled by welding the side walls 3,3 of the separators 2 to the spaced apart webs 22,22 of two support members. The rail head 10 is then lowered atop the support members 2 with the upper ends 24 thereof being inserted within the two channels 9,9. As thusly applied, it will be seen that the rail head outer flange portions 10' extend well below the horizontal plane of the center segment 20 of the rail head. Said supporting L-shaped structures 1 and 1' are then fastened to said head rail by periodically spaced horizontal bolts 11 and are in turn supported at their bases 4 and 4' by a horizontal steel base plate 7 to which they are fastened by vertical bolts 5 passing through holes 6. The bolts 11 are applied through suitable holes 12 in the support members 1 and 1' and through corresponding holes 13 in one of the flange portions 10' of the rail head 10. The bores 13' in the other rail head flange portion 10' will be seen to be tapped to accommodate the threaded tip 11' of the bolts 11, thereby providing clearance or freedom for passage of the wheel flanges (not shown) of passing trains. A longitudinally extended strip 8 of triangular cross section may be continuously welded in place to further strengthen the transverse strength of the overall construction.

The critical features of the novel compound rail are the cross-sectional shape of the rail head 10 with the channels 9 into which the vertical end portions 24 of said L-shaped support members 1 and 1' are fitted, said horizontal bolts 11 that clamp said rail head 10 to its support members 1 and 1', said regularly spaced U-shaped separators 2 with sides 3 welded to support members 1 and 1', and said base plate 7 to which said bases 4 and 4' of said L-shaped supports are attached by said vertical bolts 5.

The invention is utilized by manufacture of said compound rails and placing them on ties on rail beds of railroads requiring new rails. Later replacement of worn rails is then effected by replacing only the worn rail head portion of the compound rail described by the present invention.

The present invention may be embodied in other specific forms without departing from the spirit or essential attributes thereof, and, accordingly, reference should be made to the appended claims, rather than the foregoing specification, as indicating the scope of the invention.

What is claimed is:

1. A compound railroad track comprising;

a substantially planar rail base, a pair of longitudinal support members each including a vertically disposed web having an upper end and an opposite end joined to a horizontally extending base, means affixing said support member bases to said rail base with said webs laterally spaced apart from one another, U-shaped separators each having a transverse base joined to a pair of sides, said separators vertically extending between the majority of the height of said spaced apart support member webs and having said sides welded to said webs, a rail head having an undersurface including a center segment bounded by two laterally spaced apart downwardly facing vertical channels, said rail head defining an overall height substantially less than the height of said support member webs and provided with outermost depending flange portions respectively forming one side of each said channel and each having a lower edge disposed in a plane substantially below that of said center segment, said rail head mounted atop said support members with said web upper ends disposed within said channels and said rail head depending flange portions flushly engaging said webs with said separators extending upwardly to a plane above the plane of said flange portion lower edges, said flange portions and webs provided with aligned holes, and removable threaded bolts disposed through said aligned holes, whereby said rail head is captively secured atop said support members.

2. A compound railroad track according to claim 1 wherein, said holes in one said rail head flange portion are tapped for receiving said threaded bolts.

3. A compound railroad track according to claim 1 wherein, said separators include a top edge spaced from said rail head center segment and disposed in a plane above the plane of said aligned holes and bolts.

4. A compound railroad track according to claim 1 wherein, said affixing means includes a weld bead.

* * * * *